US007624872B2

(12) United States Patent
Elliott

(10) Patent No.: US 7,624,872 B2
(45) Date of Patent: Dec. 1, 2009

(54) LOW VAPOUR TRANSMISSION DISPENSING CONTAINER AND COVER FILM EMPLOYED THEREWITH

(75) Inventor: Howard Elliott, Kineton (GB)

(73) Assignee: Future Technology (R&D) Ltd. (GB)

( * ) Notice: Subject to any disclaimer, the term of this patent is extended or adjusted under 35 U.S.C. 154(b) by 436 days.

(21) Appl. No.: 10/571,147

(22) PCT Filed: Sep. 9, 2003

(86) PCT No.: PCT/GB03/03905

§ 371 (c)(1),
(2), (4) Date: Jun. 8, 2006

(87) PCT Pub. No.: WO2005/023670

PCT Pub. Date: Mar. 17, 2005

(65) Prior Publication Data

US 2007/0062840 A1 Mar. 22, 2007

(51) Int. Cl.
*B65D 83/04* (2006.01)

(52) U.S. Cl. ..... 206/532; 206/484.2; 206/539

(58) Field of Classification Search ..... 206/439, 206/484–484.2, 531–539, 469; 220/359.1–359.3
See application file for complete search history.

(56) References Cited

U.S. PATENT DOCUMENTS 3,894,896 A * 7/1975 Watanabe ..... 206/538
3,921,805 A 11/1975 Compere
3,924,748 A 12/1975 Braverman
3,933,559 A * 1/1976 Watanabe ..... 206/538
4,211,329 A * 7/1980 Braverman ..... 206/534
4,294,361 A 10/1981 Margulies et al.
4,316,541 A 2/1982 Braverman et al.
4,322,930 A * 4/1982 Braverman ..... 53/471
4,416,375 A * 11/1983 Braverman et al. ..... 206/534.1
4,673,086 A * 6/1987 Braverman et al. ..... 206/538
4,720,374 A * 1/1988 Ramachandran ..... 206/538
5,339,960 A 8/1994 Price
5,360,116 A 11/1994 Schmiletzky
5,944,191 A 8/1999 Ray et al.
6,161,699 A * 12/2000 Gartland ..... 206/531

FOREIGN PATENT DOCUMENTS

GB 3002309 4/2002
GB 3002310 4/2002
GB 3002243 3/2003

* cited by examiner

*Primary Examiner*—Bryon P Gehman
(74) *Attorney, Agent, or Firm*—Greensfelder, Hemker & Gale, P.C.; Peter S. Gilster

(57) ABSTRACT

A container for storing and dispensing consumer products can be used in place of conventional blister packs for packaging of pills, tablets or capsules, or as multi-cavity containers for organizing and storing mixed medication for subsequent dispensation according to a predefined dosage regimen. It has a tray (1) having a generally planar top surface (2) into which has been formed one or more discrete cavities (3) for receiving consumer products. A sheet (10) is adhered to the top surface (2) using a peelable adhesive to seal the one or more cavities (3). The sheet has pre-formed tear lines (13) defining a tear-off portion (12) per cavity to retain consumer product in that cavity until it is removed by tearing along its tear line. Each tear-off portion has low vapor transmission properties created by a patch (24) with high vapor barrier properties.

15 Claims, 4 Drawing Sheets

LOW VAPOUR TRANSMISSION DISPENSING CONTAINER AND COVER FILM EMPLOYED THEREWITH

CROSS-REFERENCE TO RELATED APPLICATION

This application is a United States national stage of PCT International Application No. PCT/GB03/003905, with international filing date of 9 Sep. 2003, published 17 Mar. 2005 as WO 2005/023670 A1, and is based upon and claims the benefit of priority of said PCT application, the entirety of which is incorporated herein by reference.

FIELD OF THE INVENTION

The invention relates to containers for storing and dispensing consumer products. The term consumer products is intended to cover a wide variety of products as illustrated by the following (non-exhaustive) list: foods, either for immediate consumption, pre-cooked, prepared or oven ready, including prepared meals, confectionary, hardware and DIY items, cosmetics, seeds, animal and fish feeds, electronic components, medical appliances and dressings, medicines and medication such as pills, tablets and capsules.

The containers may be used in place of conventional blister packs for the packaging of pills, tablets and capsules, or may be used for organising and storing mixed medication for subsequent dispensation according to a predefined dosage regimen. The principle behind such mixed medication containers is that a dosage regimen of mixed medication can be organised in advance for a period of a week or more, and a patient or nurse can then remove from the container, at predefined times over the said period, the one or more pills, tablets and/or capsules to be administered on each occasion according to the dosage regimen.

BACKGROUND ART

Blister packs are of course well known for the storage and dispensing of pills, tablets and capsules, which are stored individually in cavities in a multi-cavity tray and removed by pushing each pill, tablet or capsule through a rupturable film or foil covering the cavities. The film or foil cover may be paper or a plastics film that can be peeled or torn away to expose the medication in the tray cavities, but is generally aluminum foil, which has the dual advantage of being easily rupturable and vapour-impermeable. Such blister packs normally carry only one unit dose of the same medication in each cavity.

Mixed medication blister packs have been proposed, having larger cavities for filling by a pharmacist, wherein each cavity in a multi-cavity tray can be filled with a mixture of medications. Typically, a tray may have a 2×7, 3×7, 4×7 or 5×7 array of cavities corresponding to 2, 3, 4 or 5 predefined medication times per day over a 7-day period, or one dose prescribed per day over a 2, 3, 4 or 5 week period. For example, a 4×7 tray may be filled with the medication to be taken at breakfast-time, lunchtime, early evening and immediately before retiring each day for a week, and then the filled cavities sealed with a rupturable or sequentially rupturable film or foil cover. Printed instructions on the pack identify the intended sequence of opening the individual cavities to dispense their contents according to the prescribed dosage regimen.

Disadvantages of conventional blister packs using a rupturable cover sheet are the difficulty experienced by some patients, particularly the elderly, in pushing the medication through the cover sheet, the need for expensive laminating equipment to seal the aluminum cover sheet over the cavities after the initial filling, and the difficulty experienced by the user in selecting the cavity containing the medication to be dispensed if the medication is pushed up through the foil from below. If the wrong cavity is opened by mistake then re-sealing is impossible because the cover sheet has ruptured.

A major disadvantage of the blister pack using a peelable cover sheet is the difficulty experienced by the user in peeling or tearing away a single selected portion of the cover sheet to expose the contents of only one preselected cavity. This can be achieved by scraping a finger-nail over a comer or tab portion of a segment of the cover sheet sealing the preselected cavity, but grasping that comer to peel away the complete segment sometimes requires considerable manual dexterity and possibly good eyesight, which is beyond the abilities of many elderly users. Also, if a tacky peelable adhesive is used to adhere the cover sheet to the tray, it is desirable to prevent the contents of the tray from coming into contact with the adhesive. Finally, the film cover sheet may not have as high a vapour impermeability as metal foil, so there is a reluctance on the part of pharmacists to pre-fill a mixed medication blister pack with medication for administration more than seven days in advance of the filling date, lest the medication deteriorates due to storage in humid ambient conditions.

SUMMARY OF THE INVENTION

The invention, which aims to overcome some or all of the above problems and disadvantages, provides a container for storing and dispensing consumer products, comprising:

- a tray having a generally planar top surface into which has been formed one or more discrete cavities for receiving the consumer products; and
- a cover film to be adhered to the generally planar top surface of the tray by a peelable adhesive to seal the one or more cavities to retain the consumer products in the one or more cavities;
- the cover film having pre-formed tear lines defining a tear-off portion per cavity to retain the consumer products in that cavity until it is removed by tearing along its tear lines;
- the or each tear-off portion of the cover film having low vapour transmission properties in the area which in use overlies the associated cavity, those low vapour transmission properties being created by a patch with high vapour barrier properties shaped and sized to overlie the associated cavity and adhered to the underside of the cover film by the same layer of peelable adhesive as that which adheres the cover film to the top surface of the tray.

To dispense the contents of a cavity, the consumer simply pushes down on the associated tear-off portion with their forefinger to break the tear-lines. This requires less force than is necessary to push the consumer products through a rupturable cover sheet. The released tear-off portion is then pushed down into the cavity on top of the consumer products. The tear-off portion can be removed through the newly created opening in the cover film by sliding it up the side of the cavity until it can be grasped firmly between forefinger and thumb. Alternatively, if the tray is formed from a suitable (preferably plastics) material such that the one or more cavities are compressible, the contents of a cavity can be dispensed by pushing the consumer products through the cover film from behind and breaking the pre-formed tear-lines around the associated tear-off portion.

Because the or each tear-off portion of the cover film has low vapour permeability, the consumer products temporarily stored in the or each discrete cavity can be protected from variations in ambient humidity. Low vapour permeability is important if the container is used to store perishable consumer products such as foods or medication such as pills, tablets and capsules.

The periphery of the or each tear-off portion is preferably defined by pre-scored or pre-perforated tear lines. The pre-scored tear lines may be created by pressing a knife on to the surface of the cover film so as to cut or score part way through but not fully through the thickness of the cover film. The tear-lines defining the or each tear-off portion can extend completely around the periphery of the or each cavity, and only within the periphery of the associated patch. Alternatively, the or each tear-off portion can be attached to the remainder of the cover film by a bridge region such that the tear-lines do not extend completely around the periphery of the or each cavity. The tear-off portion and associated patch therefore remain attached to the cover film when the tear-lines are broken and the contents of the cavity are dispensed. This is more environmentally friendly because the individual tear-off portion does not have to be discarded each time the contents of a cavity are dispensed.

In a preferred embodiment of the invention, the pre-formed tear lines defining the periphery of the or each patch lie outside the pre-formed tear lines defining the periphery of the overlying tear-off portion such that the vapour-resistant patch is larger than its associated tear-off portion. It is important to note that the or each vapour-resistant patch is not adhered to the top surface of the tray, but only to the cover film.

This preferred embodiment incorporates tamper evident properties because once a tear-off portion of the cover film has been pushed down into the associated cavity and removed it cannot be easily reattached over the associated cavity. This is because the vapour-resistant patch is slightly larger than the overlying tear-off portion such that in use it overlies a region of the generally planar top surface of the tray extending completely around the periphery of the associated cavity. Once the tear-off portion and the attached vapour-resistant patch have been pushed into the cavity, there will be a narrow border of the cover film immediately outside the pre-formed tear-lines defining the periphery of the tear-off portion. It will be readily appreciated that this narrow border is adhered to the periphery of the vapour-resistant patch prior to the removal of the tear-off portion. In practice, because the underside of the cover film is covered with peelable adhesive, the narrow border will tend to adhere to the generally planar top surface of the tray. This makes it very difficult to slide the peripheral edge of the vapour-resistant patch back between the cover film and the top surface of the tray to reattach the removed tear-off portion over the associated cavity. Tamper evident properties are especially important if the container is used to store and dispense food and medication such as pills, tablets and capsules.

The patch beneath the or each tear-off portion can be created from a single sheet of barrier film as follows. A single sheet of barrier film is secured to the underside of the cover film by a peelable adhesive. The barrier film has pre-formed tear-lines defining the periphery of the or each vapour-resistant patch so that peeling away the majority of the barrier film from the cover film immediately prior to application of the cover film to secure it to the generally planar top surface of the tray exposes the peelable adhesive in areas necessary for adhesion to the tray but leaves a patch attached to the underside of the or each tear-off portion of the cover film.

The sheet of barrier film can have a further pre-defined tear line close to one edge thereof to define a tear-off strip which when removed exposes a location anchorage area of the peelable adhesive on the underside of the cover film, for adhering an edge portion of the cover film to an edge portion of the tray before peeling away the majority of the barrier film and adhering it over the cavities. To assist in the process of adhering the cover film to the top surface of the tray, the tray can have upstanding cover film location means. The cover film can have cooperating means for accurate location of the cover sheet over the tray with the one or more cavities and associated tear-off portions in register before adhering the cover film to the tray.

The cover film may be metal foil, such as aluminum foil, a metalized polymeric film or paper sheet, or a plastics film of single or multiple later construction depending on the sort of consumer products to be stored and dispensed from the container. The cover film is preferably non-rupturable (expect around the tear-lines) so that the consumer products cannot be accidentally or deliberately pushed through the cover film.

The container can be a multiple-compartment container for containing and dispensing medication according to a pre-defined dosage regimen, wherein an array of discrete cavities are formed into the generally planar top surface of the tray and the cover film has pre-formed tear lines defining an array of tear-off portions, each tear-off portion being arranged so that in use it overlies an associated one of the cavities. The cover film or (if the cover film is transparent) the tray can be printed with details of the sequence of the dosage regimen, so that the user can determine the correct sequence of opening and can push open the individual tear-off portions. The individual tear-off portions of the cover film are removed with the generally planar top surface of the tray facing upwards, so that the risk of spilling the medication onto the floor during opening is much reduced over rupturable foil covered blister packs which are generally opened in the inverted position.

DRAWINGS

Although the container according to the invention is suitable for storing and dispensing a wide range of consumer products, the rest of the specification will concentrate mainly on its use as a multiple-compartment container for organising and storing mixed medication for subsequent dispensation according to a predefined dosage regimen.

Figure 1:
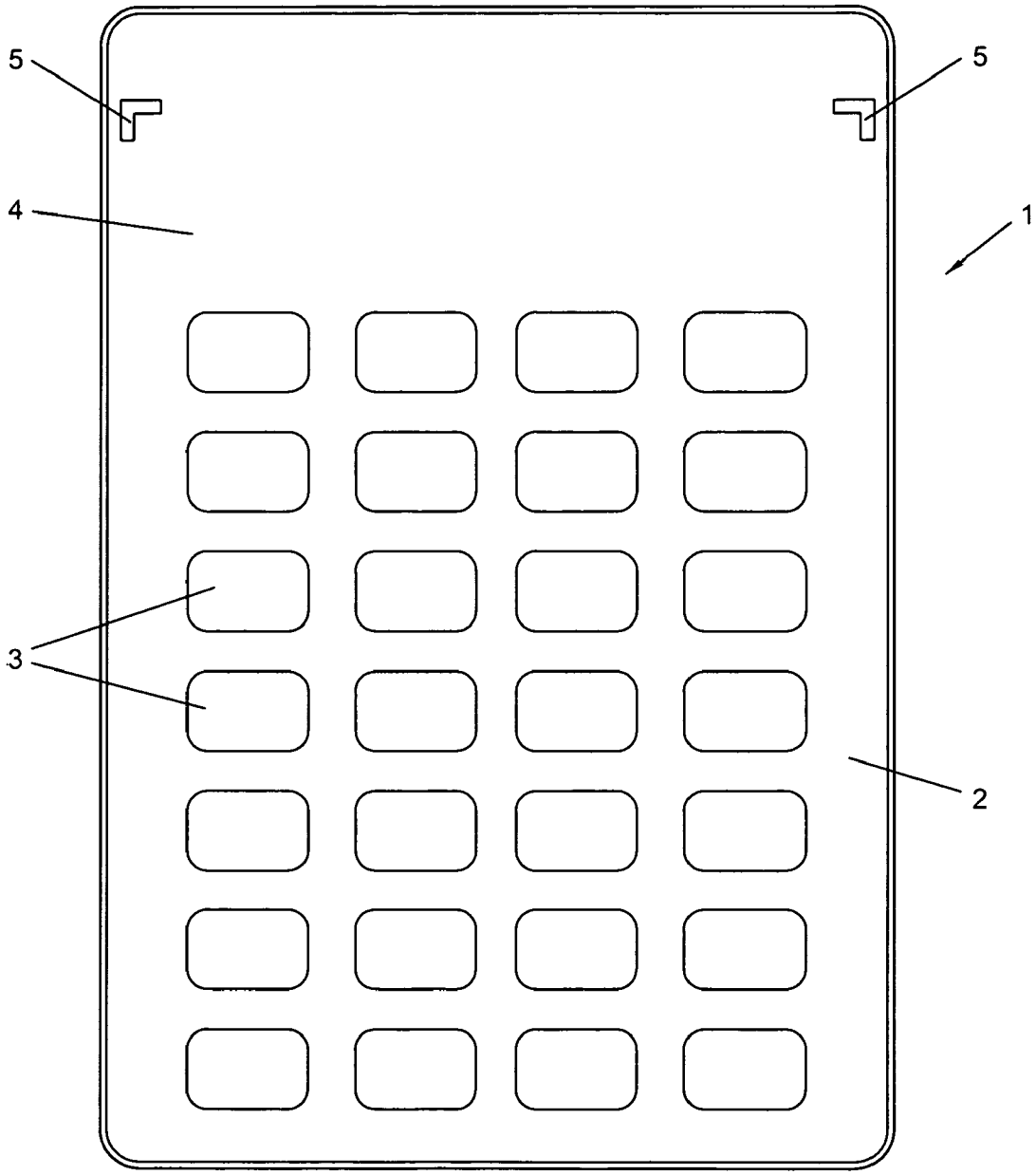
FIG. 1 is a top view of a moulded tray of a multiple-compartment container according to the invention.

Referring to FIG. 1 there is illustrated a moulded tray 1 for use in the creation of a multiple-compartment container according to the invention. The tray 1 is formed from a sheet of thermoplastic material, and may be formed for example by press moulding or by vacuum moulding. The tray 1 has a generally planar top surface 2 into which has been formed a 4×7 array of discrete cavities 3. It will be readily appreciated that other arrangements of the discrete cavities are possible depending on the particular dosage regimen required.

A flat header portion 4 immediately above the array of cavities 3 is provided for receiving printed information such as a trade mark or a pharmacy label. Close to the top comers of the header portion 4 the tray is provided with two upstanding integrally moulded location brackets 5 for the accurate location of a cover sheet in register with the cavities 3.

Figure 2:
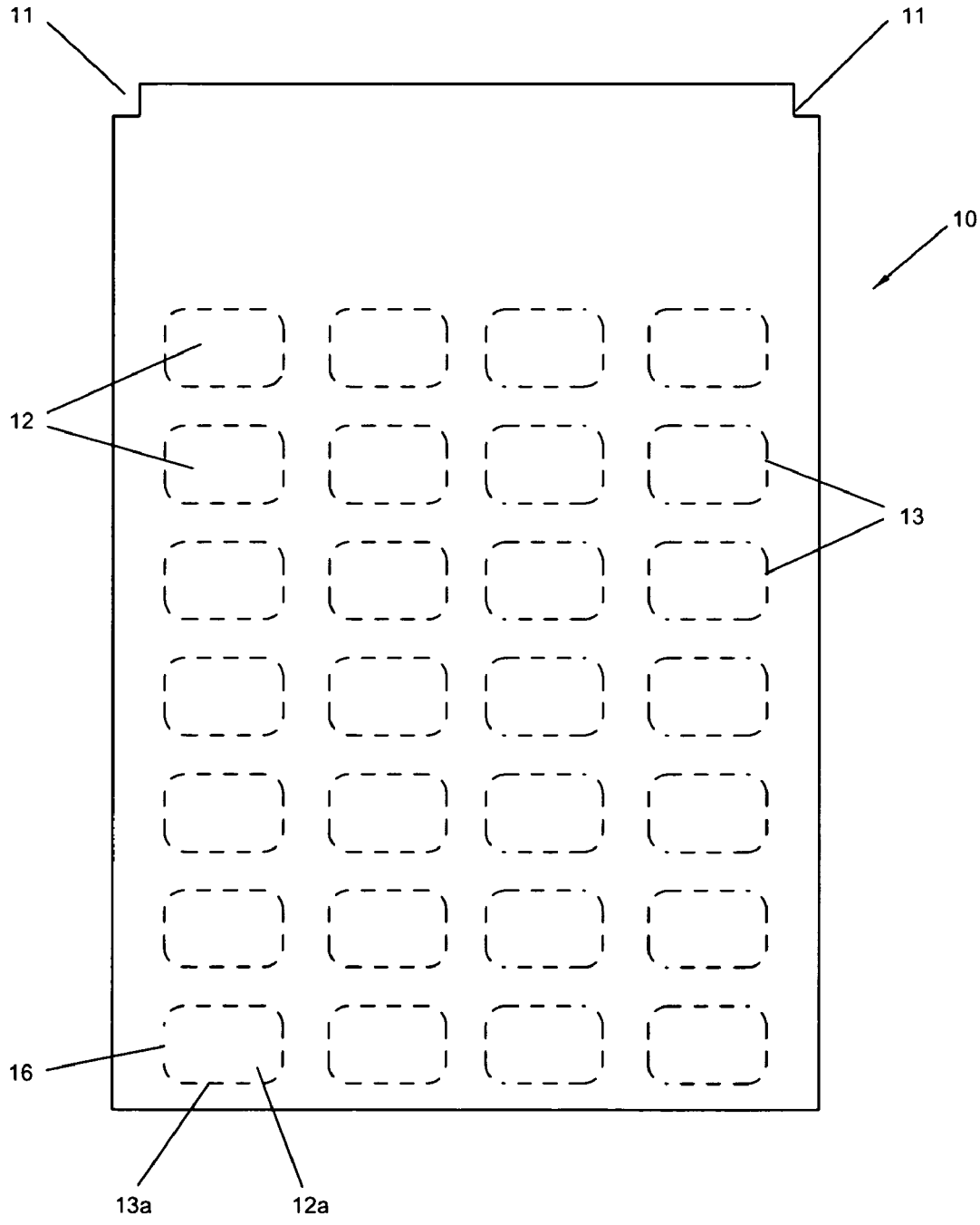
FIG. 2 is a plan view of a cover film for use with the tray of FIG. 1 to create a multiple-compartment container according to the invention.
Figure 3:
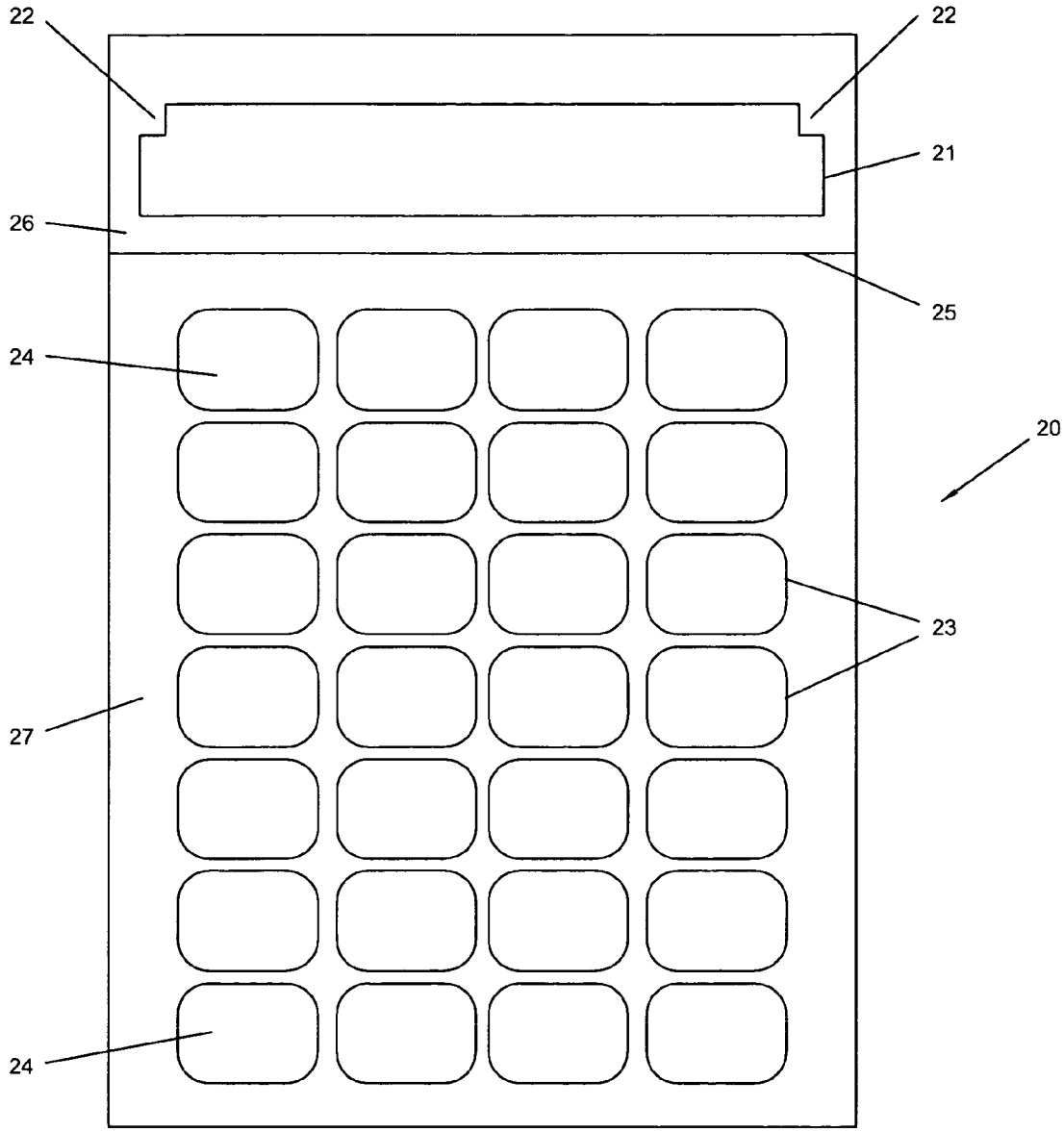
FIG. 3 is a plan view of a sheet of barrier film to be used in conjunction with the cover sheet of FIG. 2 in the creation of a multiple-compartment container according to the invention.
Figure 4:
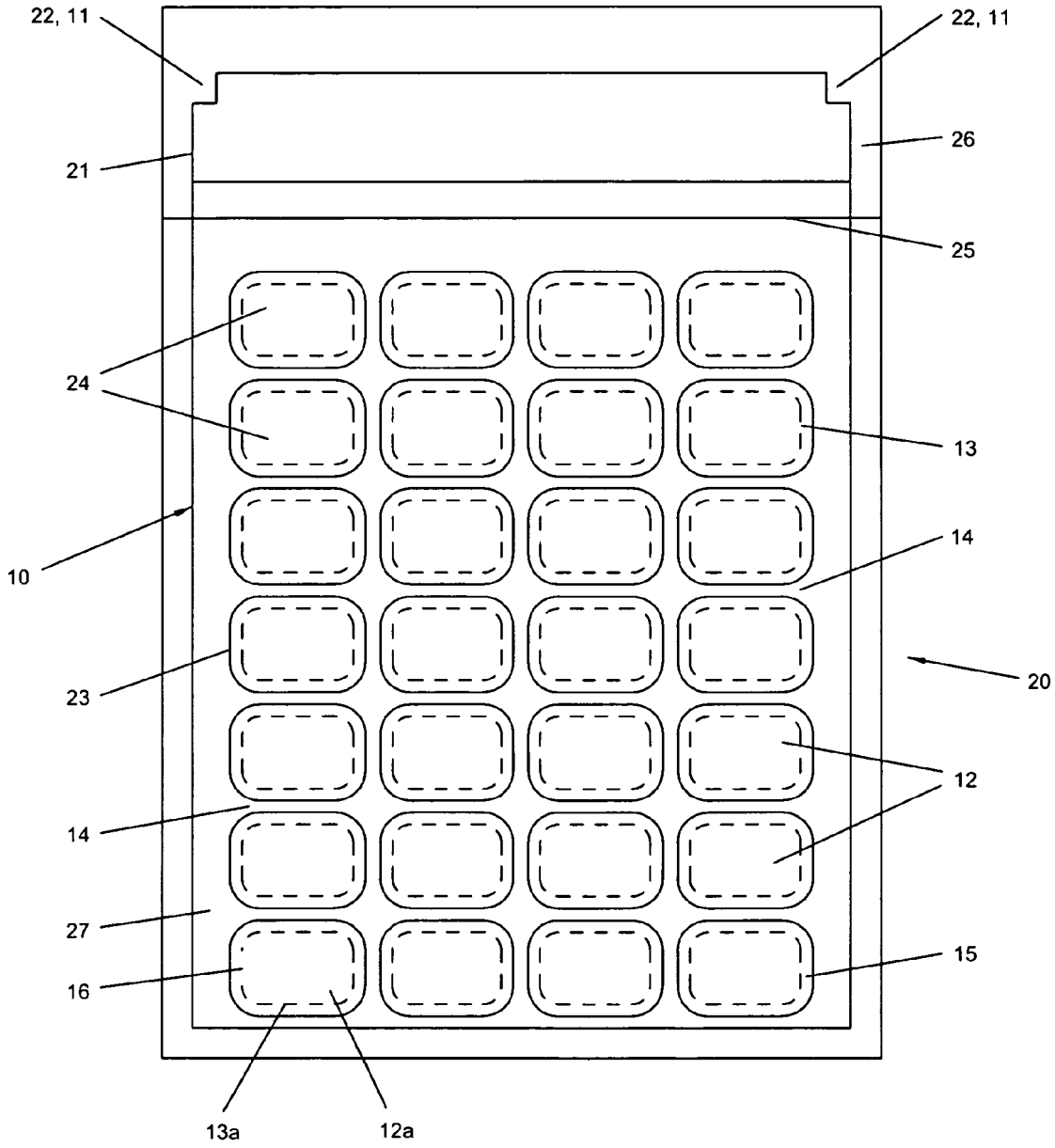
FIG. 4 is a plan view of the sheet of barrier film of FIG. 3 applied to the underside of the cover sheet of FIG. 2 prior to the assembly of the multiple-compartment container according to the invention.

The cover sheet is of a laminated construction, which can be best understood by reference to FIG. 2 to 4. The top surface of the cover sheet is the sheet 10 shown in FIG. 2. It is a sheet of smooth and flexible, and preferably transparent, plastics film, the outline of which corresponds generally to the outline of the tray 1 with which it is to be used. A pair of location rebates 11 formed in the sheet 10 cooperate with the location brackets 5 for the accurate location of the sheet 10 on the tray 1 in precise alignment one with the other. The sheet 10 includes a 4×7 array of tear-off portions 12 each of which is defined by a score line 13 that extends completely around the periphery of an underlying cavity when the sheet 10 is adhered to the top surface 2 of the tray 1. The score line 13 is a predefined zone of weakness in the sheet 10, which in use defines a preferred tear line in the plastics film. For the purposes of illustration, one tear-off portion 12 as is defined by a score line 13*a* that does not extend completely around the periphery of an underlying cavity to form a closed loop. The ends of the score line 13*a* are separated by a bridge region 16 so that the tear-off portion 12*a* remains attached to the sheet 10 even when the score line 13*a* is broken.

The entire underside of the sheet 10 is coated with a peelable adhesive. Prior to use, the sheet 10 is adhered to a barrier sheet 20 shown in FIG. 3. The barrier sheet 20 has a score line 21 defining two location rebates 22, which in use register with the location rebates 11 of the sheet 10. Score lines 23 define the outer peripheries of a 4×7 array of vapour-impermeable patches 24, which in use are adhered to underside of the respective tear-off portions 12 and lie directly over the respective cavities 3 of FIG. 1. The vapour-impermeable patches 24 are slightly larger than the tear-off portions 12 such that in use they overly a region of the generally planar top surface 2 of the tray 1 extending completely around the periphery of the respective cavities 3.

It can be seen from FIG. 4 that when the sheet 10 of FIG. 2 is placed over and adhered to the barrier sheet 20 of FIG. 3 with the location rebates 11 and 22 in register, each tear-off portion 12 has a patch 24 with low vapour transmission properties.

A further score line 25 is formed across the top part of the barrier sheet 20, beneath the location rebates 22, to define a tear-off strip 26 along the top edge of the barrier sheet.

In use, a pharmacist or a carer, or the patient himself or herself will distribute medication in the form of pills, tablets and/or capsules between the 28 discrete cavities 3 formed in the top surface 2 of the tray 1 in accordance with a 7-day or 28-day dosage regimen. For example, the seven rows of cavities represent the days of the week, and the four columns can represent either four consecutive weeks of a 28-day dosage cycle, or four different dosage times for each day of treatment. In the latter case, the first column can represent breakfast-time, the second column lunchtime, the third column early evening and the fourth column bedtime. Either a uniform medication can be distributed through the 28 discrete cavities, or a varying mixture of medications can be placed into each cavity.

When the cavities 3 have been properly filled, the assembled sheet 10 and vapour-impermeable barrier sheet 20 of FIG. 4 is placed over the tray 1 and aligned with the tray by placing the location rebates 11 and 22 next to the location brackets 5 of the tray. Holding the sheet 10 and the barrier sheet 20 in position with one hand, the tear-off strip 26 of the barrier sheet can be peeled away and the sheet 10 pressed down on to the top surface 2 of the tray 1, with the location rebates 11 returning to locate adjacent the location brackets 5 to maintain the alignment of the sheet 10 over the tray. The peelable adhesive on the underside of the sheet 10 firmly anchors the top edge of the sheet to the tray 1. At that stage, without moving the tray 1 and without disturbing the contents of the discrete cavities 3, a main portion 27 of the barrier sheet 20 can then be peeled away from under the sheet 10 so as to expose the adhesive on the underside of the sheet 10 and permit it to be adhered to the generally planar top surface 2 of the tray 1. During the peeling away of the main portion 27, the barrier sheet 20 tears around the score lines 23, leaving the patches 24 still adhered to the underside of the sheet 10.

The tear-off portions 12 and patches 24 are not adhered to the substantially planar top surface 2 of the tray 1 but are held in place by the area 14 of the sheet 10 between and around the tear-off portions and which is firmly anchored to the tray by the peelable adhesive.

To dispense the medication stored in one of the discrete cavities 3, the user simply presses down on the overlying tear-off portion 12. The application of a sufficient amount of force will cause the score lines 13 to tear such that the tear-off portion 12 is released from the remainder of the sheet 10 and can be pushed down into the cavity 3 on top of the medication. The tear-off portion 13 is easily removed through the newly created opening in the sheet 10 by sliding it up the side of the cavity 3 until it can be grasped firmly between forefinger and thumb. The medication can then be tipped out by inverting the multiple-compartment container or picked out by hand.

The tear-off portion 12*a* is released in the same way but stays attached to the remainder of the sheet 10 by the bridge region 16.

The multiple-compartment container incorporates a tamper-evident feature to make sure that nobody can interfere with the stored medication before it is properly dispensed. The tamper-evident feature arises from the fact that the vapour-impermeable patches 24 are slightly larger than the tear-off portions 12. It will therefore be readily appreciated that to fully release the tear-off portion 12, the underlying patch 24 must also be peeled away from the overlapping region 15 of the sheet 10 surrounding the score line 13. Once the tear-off portion 12 and the patch 24 have been pushed down into the cavity 3 and removed, the overlapping region 15 of the sheet 10 will tend to adhere to the generally planar top surface 2 of the tray 1. This means that the removed tear-off portion 12 cannot be reattached over the cavity 3 because it is very difficult to slide the peripheral edge of the patch 24 between the overlapping region 15 and the top surface 2 of the tray 1. Each tear-off portion 12 is the same size or slightly smaller than the openings of the cavities 3 in the tray 1. Therefore, even if the patch 24 is peeled away from the tear-off portion 12 it is still not possible to adhere the removed tear-off portion to the generally planar top surface 2 of the tray 1.

The medication does not come into contact with any exposed peelable adhesive because the underside of the tear-off portion 13 is completely covered by the patch 24.

Printed instructions to the user concerning the timing of the dosage regimen can be printed on the tray 1 (if the cover film is transparent) or on the sheet 10. Similarly, printing to identify the manufacturer of the multiple-compartment container or the pharmacy, or the patient can be printed on the header portion 4 of the tray 1, or on the sheet 10 which overlies that portion.

The invention claimed is:

1. A container for storing and dispensing consumer products, comprising:

a tray having a generally planar top surface into which has been formed one or more discrete cavities for receiving the consumer products; and a cover film to be adhered to the generally planar top surface of the tray by a layer of peelable adhesive to seal the one or more cavities to retain the consumer products in the one or more cavities;

the cover film having pre-formed tear lines defining a tear-off portion per cavity to retain the consumer products in that cavity until it is removed by tearing along its tear lines;

the or each tear-off portion of the cover film having low vapour transmission properties in the area which in use overlies the associated cavity, those low vapour transmission properties being created by a patch with high vapour barrier properties shaped and sized to overlie the associated cavity and adhered to the underside of the cover film by the layer of peelable adhesive which adheres the cover film to the top surface of the tray;

the tear line defining the or each tear-off portion extending only within the periphery of the associated patch such that the associated patch must be peeled away from an overlapping region of the cover film between the tear line and the periphery of the associated patch when the or each tear-off portion is removed.

2. A container according to claim 1, wherein the tear lines defining the or each tear-off portion extend completely around the periphery of the or each cavity.

3. A container according to claim 1, wherein the or each tear-off portion is attached to the remainder of the cover film by a bridge region defined by a gap in the associated pre-formed tear lines.

4. A container according to claim 1, wherein the patch is larger than the associated tear-off portion such that in use it overlies a region of the generally planar top surface of the tray extending completely around the periphery of the associated cavity.

5. A container according to claim 1, wherein the tray has upstanding cover film location means formed thereon, and the cover film has cooperating means for accurate location of the cover film over the tray with the one or more cavities and associated tear-off portion.

6. A container according to claim 1, wherein the cover film is one of a metal foil, a metalized polymeric film, a metalized paper sheet, and a plastics film of at least single layer construction.

7. A container according to claim 1, wherein the cover film is non-rupturable except along the tear lines.

8. A container according to claim 1, being a multiple-compartment container for containing and dispensing medication according to a pre-defined dosage regimen, wherein an array of discrete cavities are formed into the generally planar top surface of the tray and the cover film has pre-formed tear lines defining an array of tear-off portions, each tear-off portion being arranged so that in use it overlies an associated one of the cavities.

9. A cover film for use with a container for storing and dispensing consumer products comprising a tray having a generally planar top surface into which has been formed one or more discrete cavities for receiving the consumer products, the cover film being adapted to be adhered to the generally planar top surface of the tray by a layer of peelable adhesive to seal the one or more cavities to retain the consumer products in the one or more cavities;

the cover film having pre-formed tear lines defining a tear-off portion per cavity to retain the consumer products in that cavity until it is removed by tearing along its tear lines;

the or each tear-off portion of the cover film having low vapour transmission properties in the area which in use overlies the associated cavity, those low vapour transmission properties being created by a patch with high vapour barrier properties shaped and sized to overlie the associated cavity when the cover film is adhered to the generally planar top surface of the tray, the patch being adhered to the underside of the cover film by the layer of peelable adhesive which adheres the cover film to the top surface of the tray;

the tear line defining the or each tear-off portion extending only within the periphery of the associated patch such that the associated patch must be peeled away from an overlapping region of the cover film between the tear line and the periphery of the associated patch when the or each tear-off portion is removed.

10. A cover film according to claim 9, wherein the cover film carries over the whole of its underside a sheet of barrier film secured thereto by the layer of peelable adhesive, the barrier film having pre-formed tear lines defining the periphery of the high vapour barrier patch, so that peeling away the majority of the barrier film immediately prior to application of the cover film to adhere it to the generally planar top surface of the tray exposes the layer of peelable adhesive in areas necessary for adhesion to the tray but leaves the patch attached elsewhere to the underside of the cover film.

11. A cover film according to claim 10, wherein the sheet of barrier film has a further pre-defined tear line close to one edge thereof to define a tear-off strip which when removed exposes a location anchorage area of the layer of peelable adhesive on the underside of the cover film, for adhering an edge portion of the cover film to an edge portion of the tray before peeling away the majority of the barrier film and adhering it over the cavities.

12. A cover film according to claim 9, wherein the cover film is one of a metal foil, a metallised polymeric film, a metallized paper sheet, and a plastics film of at least single layer construction.

13. A cover film according to claim 9, wherein the cover film is non-rupturable except along the tear lines.

14. A container according to claim 9, wherein the tear lines defining the or each tear-off portion extend completely around the periphery of the or each cavity.

15. A container according to claim 9, wherein the or each tear-off portion is attached to the remainder of the cover film by a bridge region defined by a gap in the associated pre-formed tear lines.

* * * * *